US006213015B1

(12) United States Patent
Sato et al.

(10) Patent No.: US 6,213,015 B1
(45) Date of Patent: Apr. 10, 2001

(54) PRINTER

(75) Inventors: Mitsuo Sato, Shibata-machi; Kenji Endo, Fukushima; Toshiharu Hasegawa, Shiroishi; Yoshiharu Kanno, Sendai, all of (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/222,820

(22) Filed: Dec. 30, 1998

(30) Foreign Application Priority Data

Jan. 9, 1998 (JP) ..... 10-003254
Nov. 17, 1998 (JP) ..... 10-326518

(51) Int. Cl.[7] ..... B41L 13/00
(52) U.S. Cl. ..... 101/118; 271/10.03
(58) Field of Search ..... 101/114, 116, 101/118, 232; 271/10.03, 10.02

(56) References Cited

FOREIGN PATENT DOCUMENTS 2-144335 6/1990 (JP) .
4-23862 6/1992 (JP) .
5-18342 5/1993 (JP) .
5-32296 5/1993 (JP) .
8-259099 10/1996 (JP) .
9-20436 1/1997 (JP) .
9-26678 1/1997 (JP) .
9-30714 2/1997 (JP) .
9-235033 9/1997 (JP) .
10-139191 5/1998 (JP) .

*Primary Examiner*—Ren Yan
(74) *Attorney, Agent, or Firm*—Oblon, Spivak, McClelland, Maier & Neustadt, P.C.

(57) ABSTRACT

A printer for printing an image on a paper paid out by a pick-up roller and separated from the other papers by a separating device includes a kind-of-paper setting device for allowing the operator of the printer to select and input the kind of papers to be used. A controller automatically selects, among transport conditions stored beforehand in correspondence to the kinds of papers, optimal transport conditions matching with the kind of papers input by the operator in response to a signal received from the kind-of-paper setting device. The operator should only select and input the kind of papers while watching an LCD (Liquid Crystal Display) provided on an operation panel. The printer obviates troubles relating to the transport of papers.

52 Claims, 7 Drawing Sheets

PRINTER

BACKGROUND OF THE INVENTION

The present invention relates to a stencil printer or similar printer.

Various kinds of papers have customarily been used with a stencil printer or similar printer. Thin papers, for example, include rough printing papers and fine 45 kg papers. Papers of standard thickness (sometimes referred to as standard papers hereinafter) include copy papers, mediumquality papers, fine quality 55 kg papers, recycled papers, and fine papers for stencil printers. Further, thick papers include drawing papers, postcards, envelopes, fine 135 kg papers, and fine 160 kg papers.

To guarantee the paper feeding and discharging ability of the printer, i.e., to reduce troubles relating to paper transport as far as possible, it is necessary to variably set optimal transport conditions at the paper feed section, paper discharge section and other various sections of the printer in accordance with the kind of papers including thickness and size. This is because particular optimal transport conditions exist for each kind of papers. Necessary transport conditions to be set include a paper feed pressure, a paper separation pressure, a jump board angle and a side fence position relating to paper discharge, and a tray angle relating to paper feed. The troubles relating to paper transport are typified by the simultaneous feed of two or more papers (sometimes referred to as overlap feed hereinafter), the failure of paper feed (sometimes referred to as feed failure hereinafter), and jams occurring at the paper feed section and paper discharge section.

It is a common practice for the operator, user or serviceman (operator hereinafter) to determine the kind of papers by confirming the thickness and size of papers by eye, and manually switch a pick-up roller pressure, a separation pad pressure, a jump board angle and so forth in such a manner as to set up optimal transport conditions for the papers.

In practice, however, it is extremely difficult for an ordinary or untrained operator to determine or set optimal transport conditions paper by paper. For this reason, the manual switching function available with the printer has been rarely used, resulting in the troubles relating to paper transport.

Moreover, when any one of the troubles occurs, the operator is often simply perplexed and cannot see or execute an optimal troubleshooting measure. Although an operation manual attached to the printer describes measures for dealing with various kinds of troubles specifically, it is not readable for ordinary operators and is, if readable, troublesome and time-consuming to read.

Technologies relating to the present invention are disclosed in, e.g., Japanese Patent Publication No. 5-32296, Japanese Patent Laid-Open Publication Nos. 9-30714, 9-235033 (corresponding to U. S. Ser. No. 08/719,960, filed Sep. 24, 1996) and 10-139191 (corresponding to U.S. Ser. No. 08/925,648, filed Sep. 9, 1997), Japanese Utility Model Publication Nos. 4-23862 and 5-18342, and Japanese Patent Laid-Open Publication Nos. 9-20436, 8-259099, 9-26678, and 2-144335.

SUMMARY OF THE INVENTION

It is therefore an object of the present invention to provide a printer capable of automatically determining, only if the operator, trained or not, selects and inputs the kind of papers while watching an LCD (Liquid Crystal Display) provided on an operation panel without any manual switching operation, optimal transport conditions matching with the kind of papers and setting up the optical conditions, thereby obviating transport troubles.

It is another object of the present invention to provide a printer capable of automatically varying, only if the operator inputs the kind and degree of a transport trouble while watching an LCD provided on an operation panel, existing transport conditions, thereby setting up optimal conditions for obviating the trouble and making a troubleshooting operation extremely simple.

It is a further object of the present invention to provide a printer capable of storing optimal conditions selected and allowing them to be called every time papers of the same kind are used, thereby obviating the repetition of troublesome setting.

A printer for printing an image on a paper paid out by a pick-up roller and separated from the other papers by a separating device of the present invention includes a kind-of-paper setting device for allowing the operator of the printer to select and input the kind of papers to be used. A controller automatically selects, among transport conditions stored beforehand in correspondence to the kinds of papers, optimal transport conditions matching with the kind of papers input by the operator in response to a signal received from the kind-of-paper setting device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
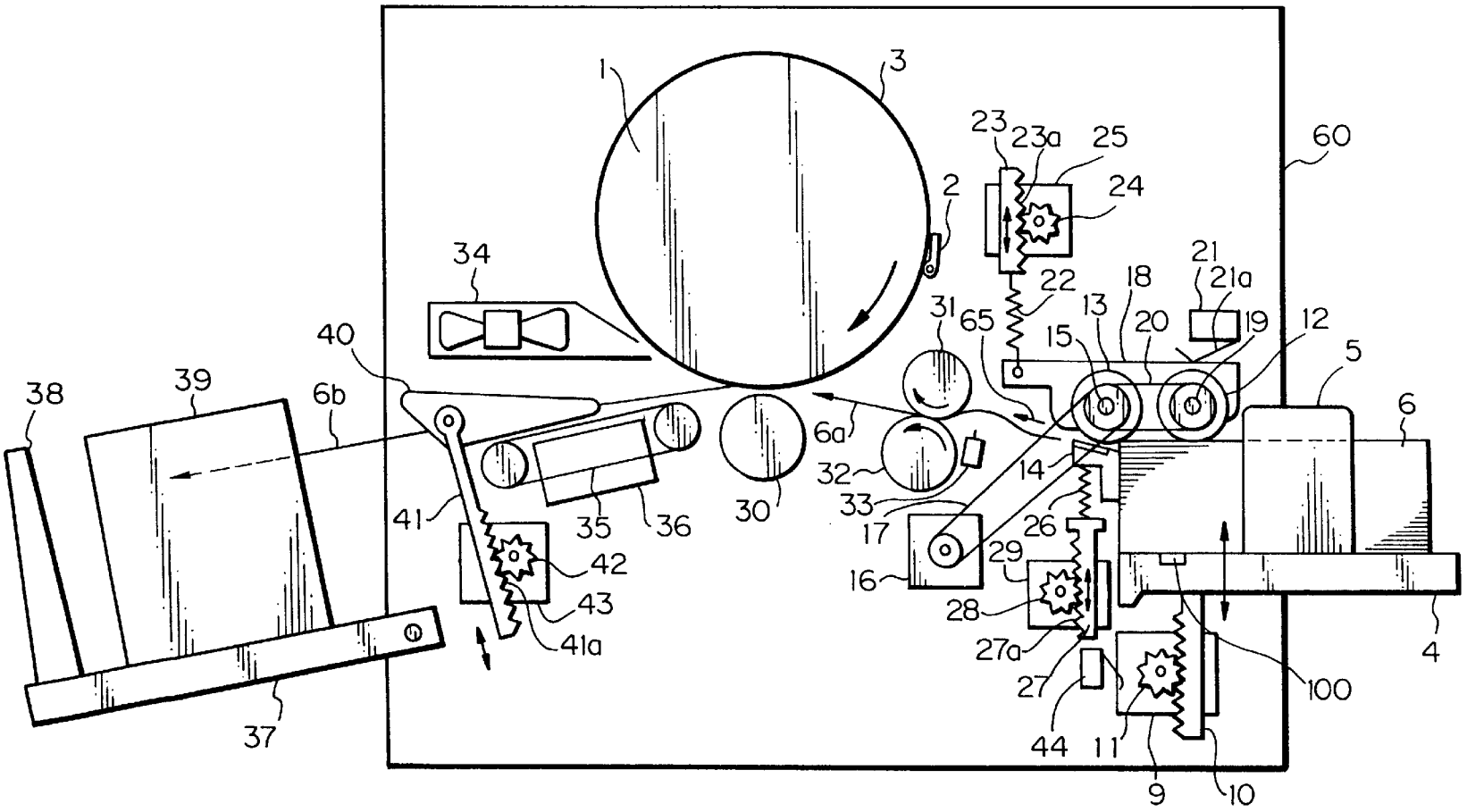
FIG. 1 is a front view showing a printer embodying the present invention.

A preferred embodiment of the printer in accordance with the present invention and modifications thereof will be described hereinafter. In the embodiment and modifications thereof, structural elements identical in configuration and/or function are designated by like reference numerals and will not be repetitively described in order to avoid redundancy.

As for structural elements provided in pairs, only one of them will be described so far as circumstances permit. Further, some structural elements which should be shown in the drawings, but do not need specific description, are not be shown for the simplicity of illustration.

Referring to FIG. 1 of the drawings, a printer embodying the present invention is shown and implemented as a stencil printer by way of example. As shown, the stencil printer includes a print drum 1. A damper 2 is mounted on the outer periphery of the ink drum 1 for clamping the leading edge of a stencil having been perforated, or cut, (master 3 hereinafter). While the print drum 1 is rotated in a direction indicated by an arrow, the master 3 is sequentially wrapped around the drum 1.

Figure 2:
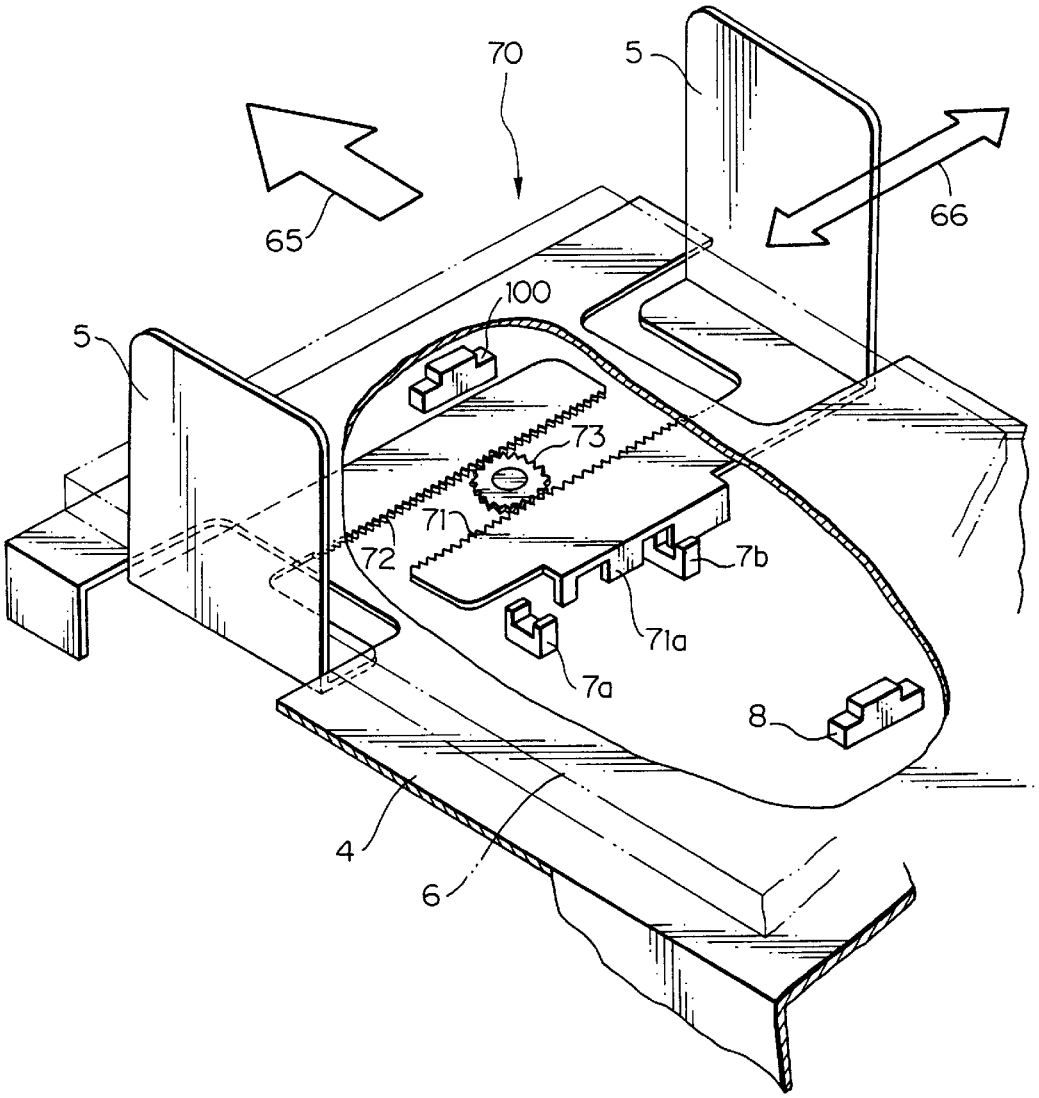
FIG. 2 is a partly taken away perspective view showing a paper size sensing mechanism included in the illustrative embodiment together with members associated with a tray.

A tray 4 loaded with a stack of papers 6 is positioned at the right-hand side of the print drum 1, as viewed in FIG. 1. As shown in FIG. 2 specifically, the tray 4 includes a right and a left side fence 5 movable toward and away from each other in the widthwise direction 66 of the papers 6 perpendicular to a paper feed direction 65. The side fences 5 are interlocked to each other for positioning the opposite side edges of the papers 6 in accordance with the size of the papers 6, as will be described in detail later.

A mechanism for sensing the size of the papers 6 will be described with reference to FIG. 2. Briefly, the mechanism senses the size of the papers 6 in interlocked relation to the movement of the side fences 5. As shown, a pinion 73 is rotatably mounted on a stationary member positioned below the tray 4. A rack 72 is formed in one bottom edge portion of the side fence 5 positioned at the left in FIG. 2. The rack 72 is held in mesh with the pinion 73. A rack 71 is formed in one bottom edge portion of the other or right side fence 5 and faces the rack 72. The rack 71 is also held in mesh with the pinion 73. A shield portion 71*a* protrudes downward from the other bottom edge portion of the right side fence 5 opposite to the rack 71 and has a plurality of notches formed at a suitable distance. Two size sensors 7*a* and 7*b* are mounted on the above stationary member at a suitable distance from each other such that the shield portion 71*a* selectively meets either one of the size sensors 7*a* and 7*b*. In addition, a size sensor 8 is mounted on the stationary member and spaced from the size sensors 7*a* and 7*b* by a suitable distance in the paper feed direction 65.

The size sensors 7*a* and 7*b* are implemented by transmission type photosensors each having a light emitting portion and a light receiving portion. The size of the papers 6 in the widthwise direction 66 is determined on the basis of the output of the size sensor 7*a* or 7*b* aligning with the shield portion 71*a*. The size sensor 8 is a reflection type photosensor having a light emitting portion and a light receiving portion and senses the size of the papers 6 in the paper feed direction 65. The size sensors 7*a*, 7*b* and 8 constitute a size sensor group 70. A CPU (Central Processing Unit), which will be described later, determines the size of the papers 6 on the basis of the combination of the outputs of the size sensor group 70.

For detals of the above paper size sensing system, reference may be made to Japanese Patent Laid-Open Publication No. 9-30714 mentioned earlier. Of course, such a paper size sensing system may be replaced any other suitable sensing system if the advantages of the interlocked side fence scheme are not necessary.

As shown in FIGS. 1 and 2, a paper sensor 100 for determining whether or not the papers 6 are present is also mounted on the stationary member of the tray 4 and implemented by a reflection type photosensor. It is to be noted that in FIG. 1 the side fences 5 are shown at a position slightly shifted to the upstream side in the paper feed direction 65 relative to the tray 4 for the clarity of illustration.

Guide means, not shown, supports the tray 4 such that the tray 4 is movable up and down therealong. As shown, in FIG. 1, a tray motor 9 drives the tray 4 up and down via a pinion gear 11 and a rack 10. The pinion gear 11 is affixed to the output shaft of the tray motor 9 while the rack 10 is affixed to the tray 4 and held in mesh with the pinion gear 11. The tray motor 9 may be implemented by a stepping motor by way of example. As shown in FIG. 1, a pick-up roller or feeding means 12 is positioned at the front side of the tray 4 for sequentially feeding the papers 6 stacked on the tray 4 one by one, the top paper 6 being first. A separator roller 13 and a separator pad 14 constituting separating means in combination are also positioned at the front side of the tray 4 in order to separate the paper 6 picked up by the pick-up roller 12 from the underlying papers 6 while conveying it. The separator roller 13 is mounted on a shaft 15 journalled to a frame 60 included in the printer body. A paper feed motor 16 is located in the vicinity of the shaft 15 for driving the separator roller 13 and constituted by a stepping motor. Specifically, the paper feed motor 16 drives the separator roller 13 via a timing belt 17 and the shaft 15. The timing belt 17 is passed over a drive pulley mounted on the output shaft of the motor 16 and a double driven pulley mounted on the shaft 15.

If desired, the pick-up roller 12 playing the role of feeding means may be replaced with, e.g., a separator/pick-up roller taught in Japanese Patent Publication No. 5-32296 mentioned earlier or a paper feed roller 104 shown in FIG. 6 of Japanese Patent Laid-Open Publication No. 9-235033 also mentioned earlier. Also, the separator roller 13 and separator pad 14 playing the role of separating means may be replaced with, e.g., a pair of rollers pressed against each other, the separator/pick-up roller and a pad taught in the above Publication No. 5-32296, or the paper feed roller 104 and a pad 106 shown in FIG. 6 of the above Laid-Open Publication No. 9-235033.

An arm 18 is rotatable about the shaft 15. The pick-up roller 12 is rotatably mounted on the free end of the arm 18 via a shaft 19. The pick-up roller 12 is therefore movable up and down about the shaft 15 integrally with the arm 18. A timing belt 20 is passed over a double driven pulley mounted on the shaft 15 and a pulley mounted on a shaft on which the pick-up roller 12 is also mounted. The paper feed motor 16 causes the pick-up roller 12 to rotate at the same time as the separator roller 13.

An upper limit sensor 21 is mounted on the frame 60 above the tray 4 for sensing the top of the paper stack 6 brought to its upper limit position. Specifically, the upper limit sensor 21 includes a feeler 21*a* and senses the upper limit position of the paper stack 6 when the upper edge of the arm 18 contacts the feeler 21*a*. A lower limit sensor 44 is positioned below the tray 4.

A mechanism for controlling the force of the pick-up roller 12 pressing the top of the paper stack 6, i.e., a feed pressure is positioned above the separator roller 13. This mechanism includes a spring or feed pressure source 22 anchored to the arm 18 at one end and to a slider 23 at the other end. The slider 23 includes a rack 23*a* and is guided by guide means, not shown, in the up-and-down direction. A variable feed pressure motor or variable feed pressure drive source 25 causes the slider 23 to move up and down via a pinion gear 24 mounted on its output shaft and meshing with the rack 23*a*. A feed displacement sensor 101 (see FIG. 3) is used to determine the displacement or position of the slider 23. The motor 25 is implemented by a stepping motor.

In the above construction, the spring 22 biases the arm 18 and thereby causes a moment of rotation to act on the pick-up roller 12. As a result, a feed pressure (sometimes referred to as a pick-up roller pressure hereinafter) acts on the top of the paper stack 6. When the motor 25 drives the slider 23 upward, as viewed in FIG. 1, the biasing force of the spring 22 (tensile force) and therefore the feed pressure increases. With the motor 25, therefore, it is possible to vary the feed pressure stepwise.

Japanese Patent Laid-Open Publication No. 9-235033, for example, teaches a position sensing board 52 included in a feed pressure adjusting mechanism. The feed displacement sensor 101, FIG. 3, may sense the displacement of the slider 23 with the same configuration as the above positionsensing board52. Alternatively, the feed displacement sensor 101 may include a photoencoder mounted on the motor 25, a shield plate mounted on the slider 23 for sensing the home position of the slider 23, and a transmission type 6 photosensor mounted on the frame 60 and selectively engageable with the shield plate.

The separator pad 14 is pressed against the bottom of the separator roller 13 for surely separating the top paper 6 from the underlying papers 6. A mechanism for controlling the force of the pad 14 pressing the paper 6 against the separator roller 13, i.e., a separation pressure includes a compression spring or separation pressure source 26 anchored to the pad 14 at one end and to a slider 27 at the other end. The slider 27 is guided by guide means, not shown, in the up-and-down direction and includes a rack 27a. A variable separation pressure motor or variable separation pressure source 29 has a pinion gear 28 mounted on its output shaft and meshing with the rack 27*a*. The motor 29 causes the slider 27 to move up and down to thereby vary the separation pressure. A separation displacement sensor 102 (see FIG. 3) senses the displacement or position of the slider 27.

The motor 29 is implemented by a stepping motor. The above Laid-Open Publication No. 9-235033, for example, teaches a position sensing board 80 included in a separation pressure adjusting mechanism 34. The separation displacement sensor 102, FIG. 3, may sense the displacement of the slider 27 with the same configuration as the above position sensing board 80. Alternatively, the sensor 102 may include a photoencoder mounted on the motor 29, a shield plate mounted on the slider 27 for sensing the home position of the slider 27, and a transmission type photosensor mounted on the frame 60 and selectively engageable with the shield plate.

The compression spring 26 presses the separator pad 14 against the separator roller 13 to thereby generate a separation pressure (sometimes referred to as a pad pressure hereinafter). When the motor 29 causes the slider 27 to move upward, as viewed in FIG. 1, the compression spring 26 is compressed to increase its compression load, i.e., the separation pressure. With the motor 29, therefore, it is possible to adjust the separation pressure stepwise.

Figure 3:
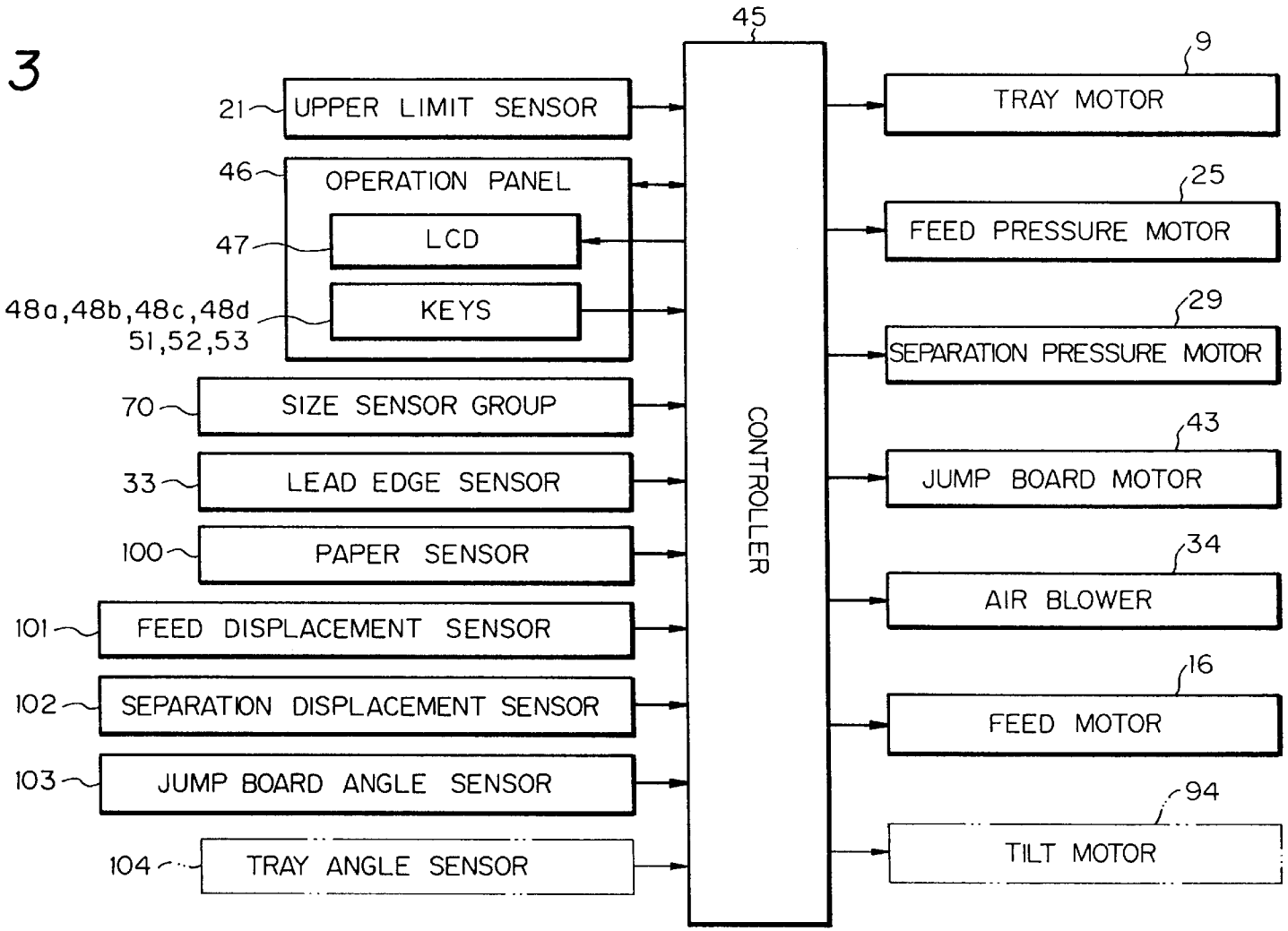
FIG. 3 is a block diagram schematically showing a control system included in the illustrative embodiment.
Figure 6:
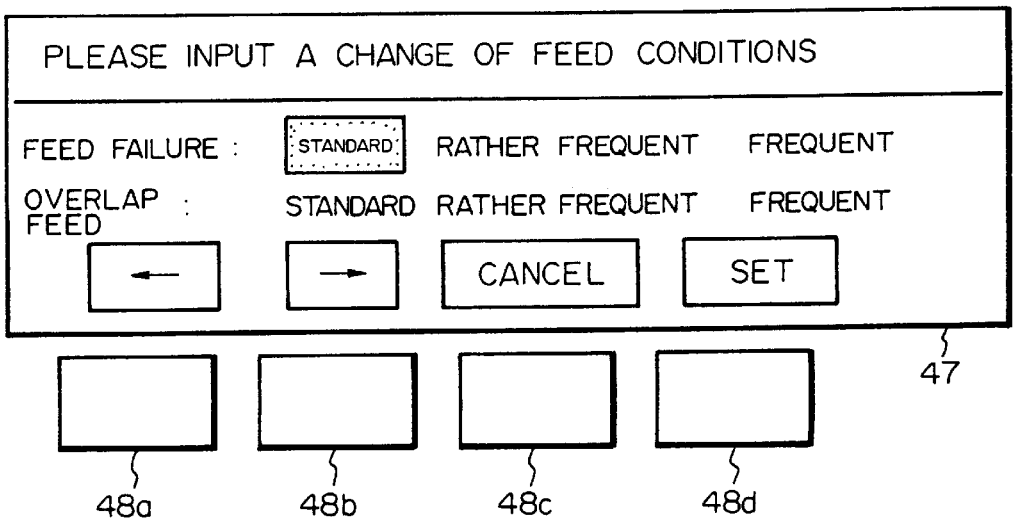
Figure 7:
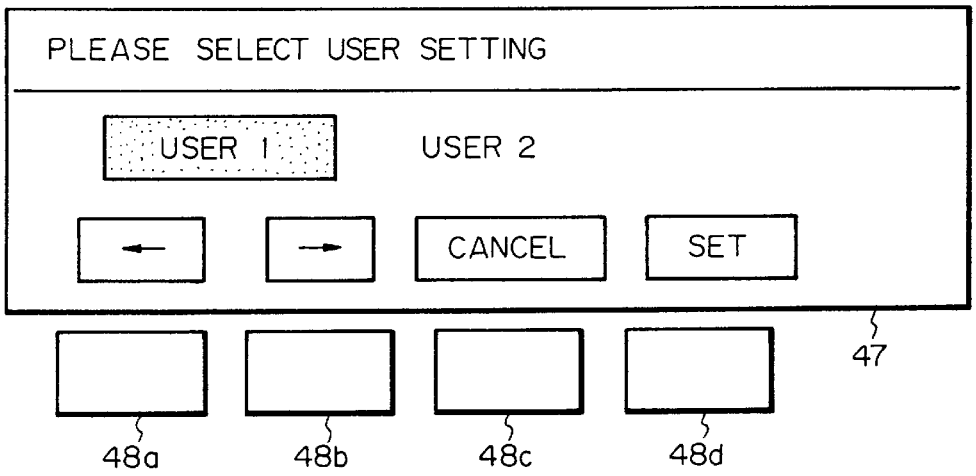
FIGS. 7 and 8 are fragmentary plan views each showing a particular picture representative of a first modification of the illustrative embodiment together with the keys associated with the LCD.

Laid-Open Publication No. 9-235033 additionally shows a feed pressure adjusting mechanism 22 and a separation pressure adjusting mechanism 34 in FIGS. 2 and 3 and a feed pressure adjusting mechanism 110 and a separation pressure adjusting mechanism 108 in FIGS. 6 and 7.

A press roller or pressing means 30 is positioned below the print drum 1 for pressing the paper, labeled 6*a*, against the drum 1 at the time of image formation. A pair of registration rollers 31 and 32 are positioned upstream of the press roller 30 in the paper feed direction 65 and feeds the paper 6*a* toward the print drum 1 and press roller 30 facing each other. The registration rollers 31 and 32 each is rotated in a particular direction indicated by an arrow. The rollers 31 and 32 cooperate to drive the leading edge of the paper 6*a* at a preselected timing based on the rotation of the print drum 1. A lead edge sensor 33 implemented by a reflection type photosensor is positioned upstream of and in the vicinity of the registration rollers 31 and 32 for sensing the leading edge of the paper 6*a*.

An air blower 34 separates the paper 6*b* carrying an image thereon from the print drum 1. A belt conveyor 35 is passed over rollers, as i llustrated. A fan 36 sucking the paper 6*b* onto the belt 35 cooperates with the belt 35 to discharge the paper 6*b* toward a tray 37. An end fence 38 and a pair of side fences 39 are positioned on the top of the tray 37. The end fence 38 stops the paper 6*a* in order to position the leading edge and trailing edge of the paper 6*a*. The side fences 39 guide and position the opposite side edges of the paper 6*b*.

A right and a left jump board 40 cause the paper, labeled 6*b*, to bend substantially in the form of a letter U before the paper 6*b* is driven out to the tray 37. The bend provides the paper 6*b* with an adequate degree of stiffness and thereby obviates a paper jam and promotes neat positioning on the tray 37. A rack-like slider 41 is anchored at one end to a part of each jump board 40 and guided in the up-and-down direction by guide means not shown. A jump board motor 43 is mounted on the frame 60 in the vicinity of the slider 41 and has a pinion gear 42 mounted on its output shaft and meshing with the rack 41*a*. The motor 43 causes the slider 41 to move in substantially the up-and-down direction. A jump board angle sensor 103 (see FIG. 3) is mounted on the lower end of the slider 41 for sensing the displacement or position of the slider 41. The motor 43 is implemented by a stepping motor. The jump board angle sensor 103 operates with the same configuration as the displacement sensor 101 or 102.

In the above construction, the motor 43 allows the angle of the jump board 40 to vary stepwise. It is therefore possible to adjust the degree of U-shaped deformation of the paper 6*b*, i.e., the degree of stiffness of the paper 6*b*.

Figure 4:
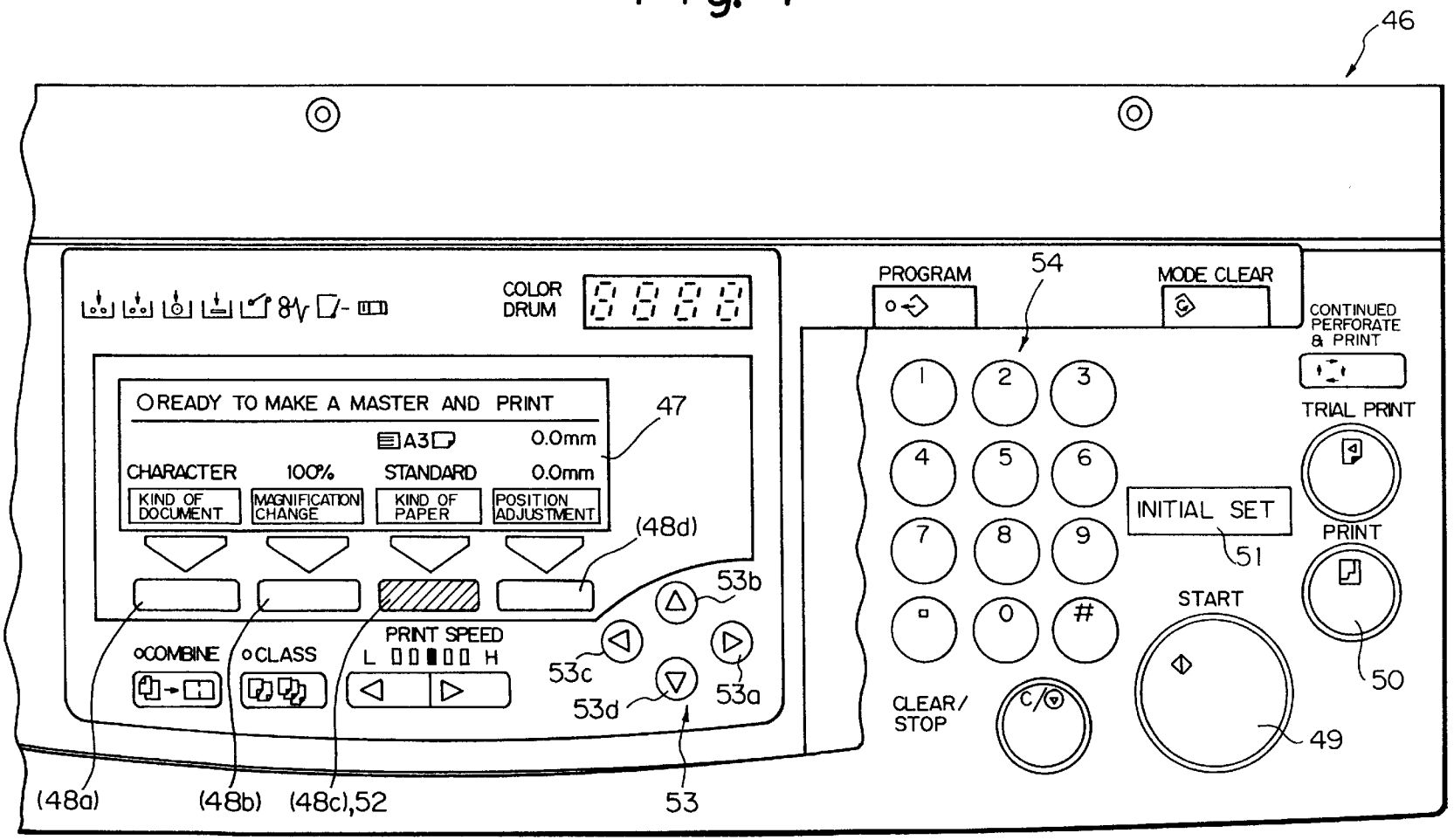
FIG. 4 is a fragmentary plan view showing an operation panel included in the illustrative embodiment.

A scanner or document reading device, not shown, is mounted in the upper portion of the frame 60, FIG. 1. FIG. 4 shows an operation panel or operation panel portion positioned above the scanner. As shown, a perforation start key 49, a print start key 50, an initial set key 51, four cursor keys 53, numeral keys 54 and so forth are arranged on the operation panel 46. Also arranged on the operation panel 46 is an LCD or display means 47. It is to be noted that the operation panel portion refers not only to the operation panel itself, but also to an easy-to-see position around the operation panel and not obstructing the operator's access. For example, the operation panel portion includes an LCD located in the vicinity of the operation panel in a standing position.

In the condition shown in FIG. 4, the LCD 47 displays an initial picture to appear when a power switch, not shown, provided on the printer is turned on. Four elongate frames appear at the bottom of the LCD 47 and respectively assigned to the kind of documents, magnification change, the kind of papers, and position adjustment. Arranged below the four frames are four elongate keys, i.e., a kind-of-document key, a magnification change key, a kind-of-paper key 52 and a position adjust key, as named from the left to the right in FIG. 4. The kind-of-document key is used to input the type of characters of documents based on the kind of documents. The magnification change key is used for enlargement or reduction in accordance with the document size. The kind-of-paper key 52 is used to input the kind of the papers 6 including the thickness and size of the papers 6. The position adjust key is used to adjust the position of an image on the paper 6 in the right-and-left and front-and-rear directions. The keys other than the kind-of-paper key 52 are not relevant to the illustrative embodiment and are not labeled for simplicity. When the kind-of-paper key 52 is pressed once, the above keys including the key 52 respectively turn out a left arrow key 48*a*, a right arrow key 48*b*, a condition change key 48*c* and a set key 48*d*, as indicated by brackets in FIG. 4. This will be described specifically later with reference to FIGS. 5–9.

The perforation start key 49 is used to set a sequence of steps beginning with the reading of a document and ending with the feed of a master or trial printing and to input such a sequence. The numeral keys 54 are used to set and input, e.g., a desired number of printings. The print start key 50 is used to start an operation for outputting the desired number of printings input on the numeral keys 54. The LCD 47 displays information set or sensed in a sequence beginning with the reading of a document and ending with printing and trouble information, as needed.

The kind-of-paper key 52 plays the role of kind-of-paper setting means for allowing the operator to select and input the kind of the papers 6 including the thickness and size of the papers 6. The left arrow key 48*a* constitutes a part of the kind-of-paper setting means and effects a leftward shift for selecting job information appearing on the LCD 47. The right arrow key 48*b* is identical in function with the left arrow key 48*a* except that it effects a rightward shift. The cursor keys 53 arranged in a cruciform configuration also constitute a part of the kind-of-paper setting means and has four shift keys 53*c*, 53*a*, 53*b* and 53*d* assigned to a leftward shift, a rightward shift, an upward shift, and a downward shift, respectively.

The condition change key 48*c* plays the role of condition changing and setting means for allowing the operator to select and input, when a trouble relating to paper transport occurs, the pattern and degree of the trouble. The set key 48*d* bifunctions as the kind-of-paper setting means and condition changing and setting means. The set key 48*d* fixes the job information selected on any one of the keys 48*a*, 48*b* and 53. It is to be noted that the keys 48*a*, 48*b* and 53 each shifts a job information message corresponding to the kind of the papers 6 selected or the pattern and degree of the trouble while highlighting the message, urging the operator to select the message. In this sense, the keys 48*a*, 48*b* and 53 play the role of the condition changing and setting means also. The LCD 47 is driven by an LCD driver, not shown, and control led by a controller 45 via the LCD driver, as will be described specifically later. As shown in FIG. 4, the LCD 47 displays at its top characters showing the outline of operation to be performed by the operator (content of a job). The LCD 47 displays at its intermediate portion characters showing the kind of papers and contents set by the operator which will be described later. Further, the LCD 47 displays at its lower portion characters showing more specific kinds of papers and displays at its bottom the kind of documents, magnification change, the kind of papers, and position adjustment stated earlier. When the kind-of-paper key 52 is pressed, a picture showing an operation to be performed when any one of the keys 48*a*, 48*b*, 53, 52, 48*c*, 48*d* and 51 is pressed appears on the LCD 47 in the form of characters or an arrow, as will be described specifically later with reference to FIG. 5.

The printer is control led by the controller or control means 45 shown in FIG. 3. The control ler 45 includes a microcomputer made up of an I/O (Input/Output) port, a ROM (Read Only memory), a RAM (Random Access Memory), a PROM (Programmable ROM) and a timer in addition to the previously mentioned CPU, although not shown specifically. Such constituents of the microcomputer are interconnected by a signal bus. The ROM stores an optimal transport condition pattern table determined beforehand by, e.g., experiments and an operation program assigned to the printer. The RAM a lows data to be written thereto, as needed.

As shown in FIG. 3, the control ler 45 adequately controls the LCD 47, tray motor 9, feed pressure motor 25, separation pressure motor 29, jump board angle motor 43, air blower 34 and feed motor 16 in response to the outputs of the upper limit sensor 21, keys arranged on the operation panel 46, size sensor group 70, lead edge sensor 33, paper sensor 100, feed displacement sensor 101, separation displacement sensor 102, and jump board angle sensor 103. It is to be noted that blocks indicated by phantom lines in FIG. 3 are not used in the illustrative embodiment, but will be used in a third modification of the illustrative embodiment to be described later.

Specifically, the controller 45 automatically selects and sets, in response to the outputs of the kind-of-paper setting means, one of various transport conditions matching with the kind of the papers 6. The transport conditions are stored in the ROM in correspondence to the kinds of papers beforehand. When a trouble relating to paper transport occurs, the controller 45 automatically selects and sets, in response to the outputs of the condition changing and setting means, corrected transport conditions stored in the ROM and matching with the kind of the papers 6.

The illustrative embodiment makes it needless for the operator to select the paper transport conditions of various sections in accordance with the kind of papers by hand. That is, only if the operator selects and inputs the kind of the papers 6 while watching the LCD 47, the controller 45 automatically determines and sets optimal transport conditions matching with the papers 6 and thereby obviates transport troubles. Hereinafter will be described the contents to appear on the LCD 47 and the operation of the five keys 52, 48*a*, 48*b*, 48*c* and 48*d*.

First, when the operator turns on the power switch of the printer, the LCD 47 displays the initial picture shown in FIG. 4. In the initial picture, a job to be performed by the operator appears at the top. In FIG. 4, a specific message "Ready to make a master and print." appears to show the operator that the printer is ready to perform the sequence beginning with master making and ending with printing.

Assume that the operator watching the initial picture on the LCD 47 presses the kind-of-paper key 52. Then, a picture shown in FIG. 5 appears on the LCD 47 in place of the initial picture. As shown, four kinds of papers, i.e., "Standard Paper", "Thin Paper", "Thick Paper" and "Envelope" and "User 1" and "User 2" are included in the picture. "User 1" and "User 2" each allows the user to select a special kind of papers, as will be described specifically later. The illustrative embodiment allows the user to select transport conditions delicately in accordance with the kind of the papers 6. This is why the above four different kinds of papers are displayed and selected by any one of the keys 48*a*, 48*b*, 53 and 48*d*. If such delicate selection is not necessary, at least "Standard Paper" and "Thick Paper" suffice, as determined by a series of experiments.

The operator may not be fully informed of the contents of "Standard Paper". In light of this, when the kind of the papers 6 is set via the kind-of-paper setting means, the illustrative embodiment displays together with "Standard Paper" more specific contents of the kind of the paper 6. This allows the operator to easily see the kind of the papers 6 and select it immediately.

Usually, "Standard Paper" is selected and highlighted in black. The operator presses any one of the left arrow key 48*a*, right arrow key 48*b*, shift keys 53*c* and 53*a* in order to shift the highlighted portion and then presses the set key 48*d*. In the specific condition shown in FIG. 5, "Standard Paper" is selected as the kind of the papers 6, and "Ex. copy paper, medium quality paper, fine paper, recycled paper" is displayed below "Standard Paper" as more specific kinds. Likewise, when "Thin Paper" is selected, "Ex. rough printing paper" is displayed. For "Thick Paper", "Ex. drawing paper, postcard" is displayed. For "Envelope", "Ex. long, square and other regular envelopes" is displayed.

The operator having selected the kind of the papers 6 shifts the highlighted portion to the set key 48*d* on any one of the keys 48*a*, 48*b*, 53*c* and 53*a* in order to input the kind of the papers 6. In response, the controller 45 automatically selects optimal transport conditions for the kind of the papers 6 input, i.e., a pick-up roller pressure, a pad pressure and a jump board angle out of a transport condition pattern table listed in Table 1 below.

TABLE 1

| | Pick-Up Roller Pressure | Pad Pressure | Jump Board Angle |
|---|---|---|---|
| Standard | 1 | 4 | Medium to large |
| Thin | 1 | 2 | large |
| Thick | 3 | 2 | small |
| Envelope | 2 | 1 | small |

Then, the control ler 45 controls the feed pressure motor 25, separation pressure motor 29 and jump board motor 43 such that the above pick-up roller pressure, pad pressure and jump board angle selected are set up. In this manner, transport conditions adequate for the kind of the papers 6 input are automatically set up.

Table 2 shown below is supplementary to the contents of Table 1 and roughly shows a relation between the pick-up roller pressure, pad pressure, feed failure, and overlap feed.

TABLE 2

| | Frequent Feed Failure ⟷ Frequent Overlap Feed |
|---|---|
| Pick-Up Roller Pressure | low ⟷ high |
| Pad Pressure | high ⟷ low |

As shown in Table 2, the pick-up roller pressure causes paper feed to fail if excessively low or causes two or more papers to be fed at the same time if excessively high. In light of this, for thin papers or standard papers, a pick-up roller pressure lying in a low to medium range is selected as far as possible, as shown in Table 1 (corresponding to numerical value "1"; the pressure decreases with a decrease in the numerical value). For thick papers needing a great conveying force, a pick-up roller pressure lying in a high range (corresponding to numerical value "3"; the pressure increases with an increase in the numerical value) is selected. For envelopes, a pick-up roller pressure between the above two ranges (corresponding to numerical value "2") should preferably be selected, as experimentally proved.

As shown in Table 2, the pad pressure causes paper feed to fail if excessively high or causes two or more papers to be fed at the same time if excessively low. In light of this, for standard papers, a pad pressure lying in a medium to high range is selected in order to obviate over lap feed, as shown in Table 1 (corresponding to numerical value "4"; the pressure increases with an increase in the numerical value). However, for thin papers, a pad pressure lying in a low to medium range (corresponding to numerical value "2"; the pressure decreases with a decrease in the numerical value) is selected because higher pressures would cause the papers to crease. For thick papers, too, the pad pressure Lying in the low to medium range (corresponding to numerical value "2") is selected because higher pressures would cause the papers to peel off. For envelopes, a pad pressure lying in a low range (corresponding to numerical value "1" should preferably be selected, as experimentally determined.

As for the jump board angle, a medium to large range should be selected for standard papers in order to provide the papers with a sufficient degree of stiffness. This is also true with thin papers. For thick papers and envelopes, stiffening is not necessary and cannot be effected because such papers are originally stiff. Therefore, a small jump board angle must be selected for thick papers.

The transport condition pattern table of Table 1 is determined beforehand on the basis of, e.g., the results of experiments and stored in the ROM of the controller 45.

In the illustrative embodiment, the transport condition pattern table lists only pick-up roller pressures, pad pressures and jump board angles in relation to the kinds of the papers 6. For more delicate control, the table may additionally list, paying attention to the slip of the separator roller 13, the amount of rotation of the separator roller 13 or list, paying attention to the rolling of papers, the velocity of air to issue from the air blower 34.

A specific procedure for the operator to select and input the kind of the papers 6 and a paper feed and printing operation will be described hereinafter. First, when the operator turns on the power switch of the printer, the initial picture shown in FIG. 4 appears on the LCD 47. The initial picture shows the previously mentioned message "Ready to make a master and print." at its top, showing a job to be performed by the operator.

The operator watching the initial picture presses the kind-of-paper key 52. Then, the picture shown in FIG. 5 appears on the LCD 47 in place of the initial picture. This picture shows a message "Please select the kind of papers." at its top. Usually, "Standard Paper" is highlighted in the picture of FIG. 5. When the operator desires to use drawing papers (thick papers) by way of example, the operator shifts the highlighted portion to the position of "Thick Paper" on the right arrow key 48*b* (arrow →) or the shift key 53*a* and then inputs it on the set key 48*d*. As a result, "Ex. drawing paper, postcard" appears in the lower portion of the LCD 47, allowing the operator to easily see that drawing papers belong to a group of thick papers. The operator can therefore immediately select and input "Thick Paper" without any doubt.

Figure 5:
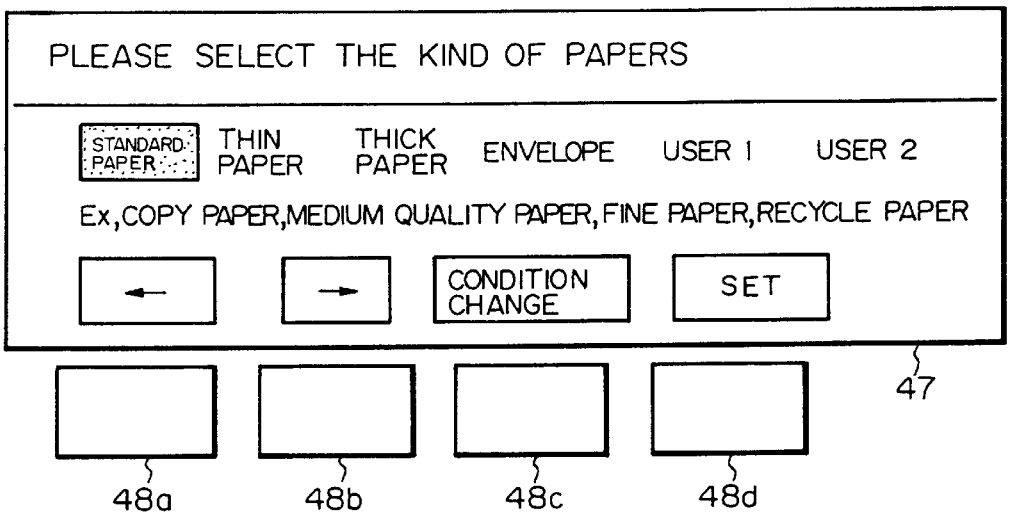
FIGS. 5 and 6 are fragmentary plan views each showing a particular picture to appear on an LCD included in the operation panel together with keys associated with the LCD.

When the operator selects "Thick Paper" in the picture shown in FIG. 5, the controller 45 automatically selects the optical conditions for the thick papers 6, i.e., a pick-up roller pressure "3", a pad pressure "2" and a jump board angle "small" out of the transport condition pattern table of Table 1. Then, the controller 45 controls the motors 25, 29 and 43 such that the above particular numerical values are set up.

The operator having input the kind of the papers 6 presses the perforation start key 49. In response, the conventional operation of the scanner for reading a document and the conventional automatic master making operation proceed in parallel. As a result, a master is wrapped around the print drum 1. When the tray 4 is positioned at its lower limit position, as determined by the lower limit sensor 44, the operator having input the kind of the papers 6 stacks the papers or drawing papers 6 on the tray 4 and then presses the print start key 50. In response, the controller 45 causes the tray motor 9 to lift the tray 4.

When the top of the paper stack 6 contacts the pick-up roller 12 and pushes it upward, the arm 18 also rises and presses the feeler 21*a* of the upper limit sensor 21. As a result, the upper limit sensor 21 is turned on and sends an ON signal to the controller 45. In response, the control ler 45 deenergizes the tray motor 9 and thereby stops the tray 4 at a preselected level for paper feed (paper feed position hereinafter). This is followed by a print mode operation. If the operator's recognition as to "Thick Paper" is objectively correct, then printing will occur under the adequate transport conditions from the beginning.

Subsequently, the print drum 1 is caused to rotate while the pick-up roller 12 is rotated by the feed motor 16. The pick-up roller 12 pays out the top paper 6 in the paper feed direction 65. The separator roller 13 and pad 14 cooperate to separate the top paper 6 from the underlying papers. Because the optimal transport conditions have already been set up, the papers 6 are surely fed one by one without jamming the transport path due to, e.g., feed failure.

When several papers 6 are fed out from the top of the paper stack on the tray 4, the pick-up roller 12 and therefore the arm 18 is lowered. On sensing the arm 18, the upper limit sensor 21 turns off and sends an OFF signal to the control ler 45. In response, the controller 45 again energizes the tray motor 9. As a result, the tray 4 is again raised until the upper limit sensor 21 turns on. In this manner, the tray motor 9 is selectively energized or deenergized in order to raise the tray 4 intermittently to the paper feed position.

The paper 6 fed out by the separator roller 13 abuts against the nip between the registration rollers 31 and 32 and is caused to suitably bend thereby. The registration rollers 31 and 32 start rotating in synchronism with the rotation of the ink drum 1, feeding the paper 6 at a preselected timing. An image is printed on the paper 6 at the nip between the print drum I and the press roller 30. Thereafter, the paper 6 with the image, i.e., a printing is driven out to the tray 37. Because the optimal jump board angle has already been set up, the printing 6 is neatly positioned on the tray 37 with adequate stiffness (except when the paper is thick). The above procedure is repeated with the successive papers 6. That is, a single paper 6 is fed and printed for one rotation of the print drum 1 without any jam or similar transport trouble and then driven out of the printer without any jam or similar transport trouble.

Even though the papers 6 are sequentially transported under the optimal transport conditions, a transport trouble may occur depending on the brand or the kind of the papers 6, environmental conditions including temperature and humidity, and the degree of curl. In such a case, the operator may restore the picture shown in FIG. 5 in order to correct the transport conditions. When the operator watching the picture of FIG. 5 presses the condition change key 48*c*, a picture shown in FIG. 6 appears on the LCD 47 in place of the picture of FIG. 5.

In FIG. 6, a message "Please select a change of paper feed conditions." is shown at the top of the picture. When overlap feed, for example, frequency occurs, the operator may press the right arrow key 48*b* (arrow →) five times (or press the shift key 53*d* once and then the shift key 53*a* twice) so as to shift the highlighted portion from "standard" to "Overlap feed: frequent), and then press the set key 48*d*. As a result, the transport conditions (paper feed conditions) are corrected, as listed in Table 3 shown below. Table 3 will be referred to as a corrected transport condition pattern table.

TABLE 3

| | Rather Frequent Feed Failure Pick-Up Roller Pressure | Frequent Feed Failure Pick-Up Roller Pressure | Rather Frequent Overlap Feed Pad Pressure | Frequent Overlap Feed Pad Pressure |
|---|---|---|---|---|
| Standard | 3 | 5 | 5 | 6 |
| Thin | 3 | 5 | 3 | 4 |
| Thick | 5 | 6 | 3 | 4 |
| Envelope | 3 | 5 | 2 | 3 |

The above corrected transport condition pattern table is stored in the ROM beforehand for the reasons according to the reasons stated in relation to Tables 1 and 2 and on the basis of experimental results.

When the operator selects the change of paper feed conditions, the control ler 45 automatically selects optimal transport conditions, i.e., pick-up roller pressure, pad pressure and jump board angle listed in the above pattern table and matching with the kind of the papers 6. Then, the controller 45 controls the variable feed pressure motor 25, variable separation pressure motor 29 and jump board motor 43 such that the above corrected transport conditions are set up. The operator therefore should only select and input information matching with the pattern and degree of the transport trouble on any one of the keys 48*c*, 48*a*, 48*b* and 48*d*. In response, the controller 45 automatically varies the existing transport conditions in order to avoid the transport trouble.

When the power switch is turned off, the corrected transport conditions are automatically replaced with the "standard" conditions. If desired, the corrected transport conditions may be temporarily stored by a preselected operation.

A first modification of the illustrative embodiment is as follows. This modification copes with special papers 6 particular to the user of the printer and unable to be adequately transported when any one of the standard papers, thin papers, thick papers and envelopes discussed above is selected. For this purpose, the modification allows the operator to select "User 1" or "User 2" mentioned previously for inputting optical transport conditions particular to the user. The ROM or the PROM stores many transport condition patterns beforehand in addition to the transport condition pattern table and corrected transport condition pattern table corresponding to the four different kinds of papers 6. Any one of such additional tables is selected in accordance with transport conditions and allocated to "User 1" or "User 2" and can be called any time. The allocation of the additional table is performed in an initial set mode. The controller 45 includes the following additional control functions for executing the initial set mode.

Figure 8:
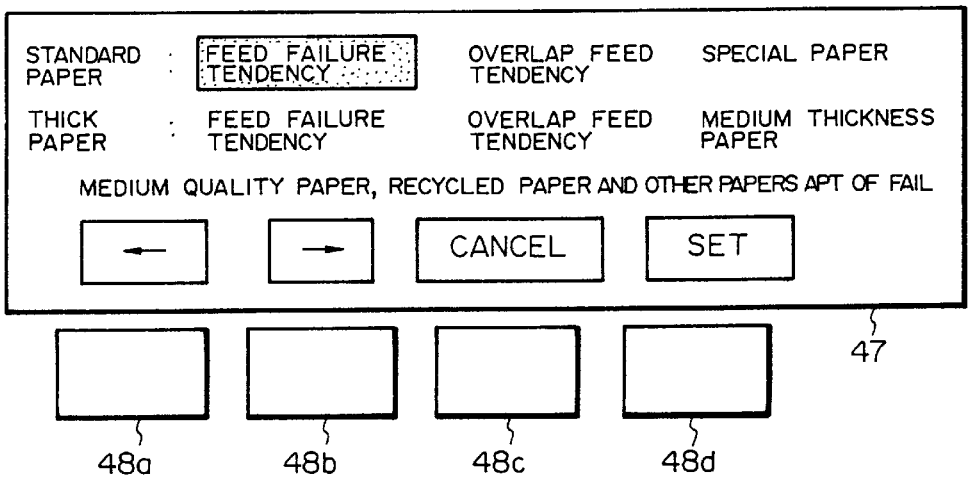

When the operator presses the initial set key 51 on the operation panel 46, a picture shown in FIG. 7 appears on the LCD 47. As shown in FIG. 7, "User 1" is initially highlighted. When the operator watching the picture of FIG. 7 presses the set key 48*d*, the LCD 47 shows a picture shown in FIG. 8. As shown in FIG. 8, "Standard Paper: feed failure tendency" is highlighted. When the operator 48*d* watching the picture of FIG. 8 presses the set key 48*d*, "Standard Paper: feed failure tendency" is allocated to "User 1". In the picture of FIG. 8, examples of the papers 6 belonging to the highlighted kind are shown at the third row in a readable manner. This allows anyone to easily see the kind of papers 6 referred to by "Standard Paper: feed failure tendency". As for "Thick Paper: feed failure tendency", there may be displayed "Drawing paper and other thick papers apt to fail". As for "medium thickness paper", there may be displayed "Paper between standard paper and thick paper".

In FIG. 8, "special paper" refers to papers set independently of the other papers, e.g., rare papers needing particular transport conditions and needing a serviceman.

Table 4 shown below is representative of a transport condition pattern table listing specific transport conditions to be allocated to "User 1" or "User 2".

TABLE 4

| | Pick-Up Roller Pressure | Pad Pressure | Jump Board Angle |
|---|---|---|---|
| Standard: Feed Failure Tendency | 3 | 4 | large to medium |
| Standard: Overlap Feed Tendency | 1 | 5 | large to medium |
| Thick: Feed Failure Tendency | 5 | 2 | small |
| Thick: Overlap Feed Tendency | 3 | 4 | small |
| Medium Thick | 3 | 3 | medium |
| Special | blank | blank | blank |
| Thin | 1 | 1 | large |

The data listed in Table 4 are stored in the ROM or the PROM beforehand for the same reasons as stated in relation to Tables 1 and 2 and on the basis of experimental results.

A conventional construction using a plurality of paper sensors may be used to detect transport troubles including over lap feed, feed jam and discharge jam, although not shown or described specifically.

If desired, an arrangement may be made such that when the paper sensor 100 determines that papers are absent or when the lower limit sensor 44 senses the lower limit position, the LCD 47 displays the kind of the current papers 6 and a message inquiring the operator whether or not to clear the current setting.

A second modification of the illustrative embodiment will be described hereinafter. As for the kind of the papers 6, the illustrative embodiment has concentrated on the thickness of the papers 6. The second modification differs from the illustrative embodiment mainly in that it pays attention to the size of the papers 6 in selecting optical transport conditions.

Figure 9:
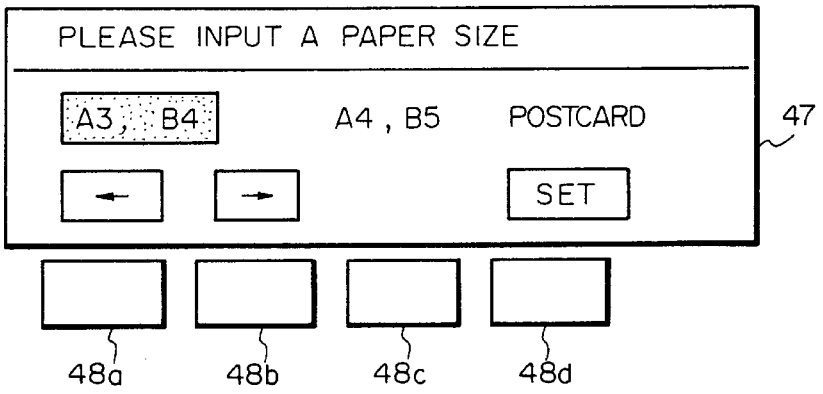
FIG. 9 is a fragmentary plan view showing a specific picture representative of a second modification of the illustrative embodiment together with the keys associated with the LCD.

Specifically, when the operator watching the initial picture shown in FIG. 4 presses the kind-of-paper key 52, a picture shown in FIG. 9 appears on the display 47. In FIG. 9, a message "Please select a paper size. " is shown at the top of the picture. "A3, B4", "A4, B5" and "Postcard" are shown at the second row of the same picture as paper sizes. In this modification, any one of the above three different groups of paper sizes is automatically selected, as follows.

In the second modification, the paper size sensing mechanism including the size sensor group 70, FIGS. 2 and 3, automatically determines the size of papers. When the papers 6 stacked on the tray 4 are of size A3 or B4 by way of example, "A3, B4" is highlighted in the picture of FIG. 9, informing the operator of the automatic selection of the paper size. The operator therefore should only press the set key 48*d* after confirming the highlighted paper size. In response, the controller 45 automatically selects optimal transport conditions matching with the above paper size, i.e., a pick-up roller pressure, a pad pressure and a jump board angle out of a transport condition pattern table based on experimental results and stored in the ROM beforehand. Table 5 shown below is the transport condition pattern table.

TABLE 5

| Paper Size | Pick-Up Roller Pressure | Pad Pressure | Jump Board Angle |
|---|---|---|---|
| A3, B4 | 3 | 3 | medium |
| A4, B5 | 1 | 2 | large |
| Postcard | 2 | 1 | small |

The controller 45 controls the feed pressure motor 25, separation pressure motor 29 and jump board motor 43 such that the optimal pick-up roller pressure, pad pressure and jump board angle matching with the paper size selected are set up. To supplement the contents of Table 5, for the papers 6 of relatively large size A3 or B4 needing a great conveying force, a high pick-up roller pressure is selected (corresponding to numerical value "3"). For the papers 6 of relatively small size A4 or B5 not needing a great conveying force, a low pick-up roller pressure is selected (corresponding to numerical value "1"). For postcards, a pick-up roller pressure substantially between the above high and low pick-up roller pressures should preferably be selected (corresponding to numerical size "2"), as experimentally proved.

A high pad pressure (corresponding to numerical value "3") is selected for the papers 6 of relatively large size A3 or B4 in order to avoid overlap feed. However, amedium pad pressure (corresponding to numerical value "2") is selected for the papers 6 of relatively small size A4 or B5. Likewise, a low pad pressure (corresponding to numerical value "1") is selected for postcards, as determined on the basis of the results of experiments.

A large jump board angle is selected for the papers 6 of relatively small size A4 or B5 in order to provide them with a sufficient degree of stiffness. This is also true with the papers 6 of relatively large size A3 or B4. However, for postcards, a relatively small jump board angle is selected because postcards are originally stiff and because they cannot be stiffened.

The above automatic paper size selection using the size sensor group 70, FIGS. 2 and 3, may be replaced with manual paper size selection, if desired. Specifically, assume that the operator stacks the papers 6 of size A4 or B5 on the tray 4. In the picture shown in FIG. 9, "A3, B4" is initially highlighted, as stated earlier. The operator may shift the highlighted portion to "A4, B5" on either one of the keys 48*a*, 48*b*, 53*c* and 53*a* and then press the set key 48*d*.

Of course, the contents of Table 3 or 4 are also applicable to the second modification. In the second modification, Table 5 lists only the pick-up roller pressures, pad pressures and jump board angles as transport conditions in relation to the sizes of the papers 6 to be selected. For more delicate control, the table may additionally list, paying attention to the slip of the separator roller 13, the amount of rotation of the separator roller 13 or list, paying attention to the rolling of papers, the velocity of air to issue from the air blower 34. Further, the thickness and size of the papers 6 may, of course, be combined for even more delicate control.

A third modification of the illustrative embodiment is as follows. The third modification differs from the illustrative embodiment mainly in that it adopts a tray angle as a transport condition in addition to the pick-up roller pressure, pad pressure, and jump board angle in order to implement more delicate control over the transport conditions.

Figure 10:
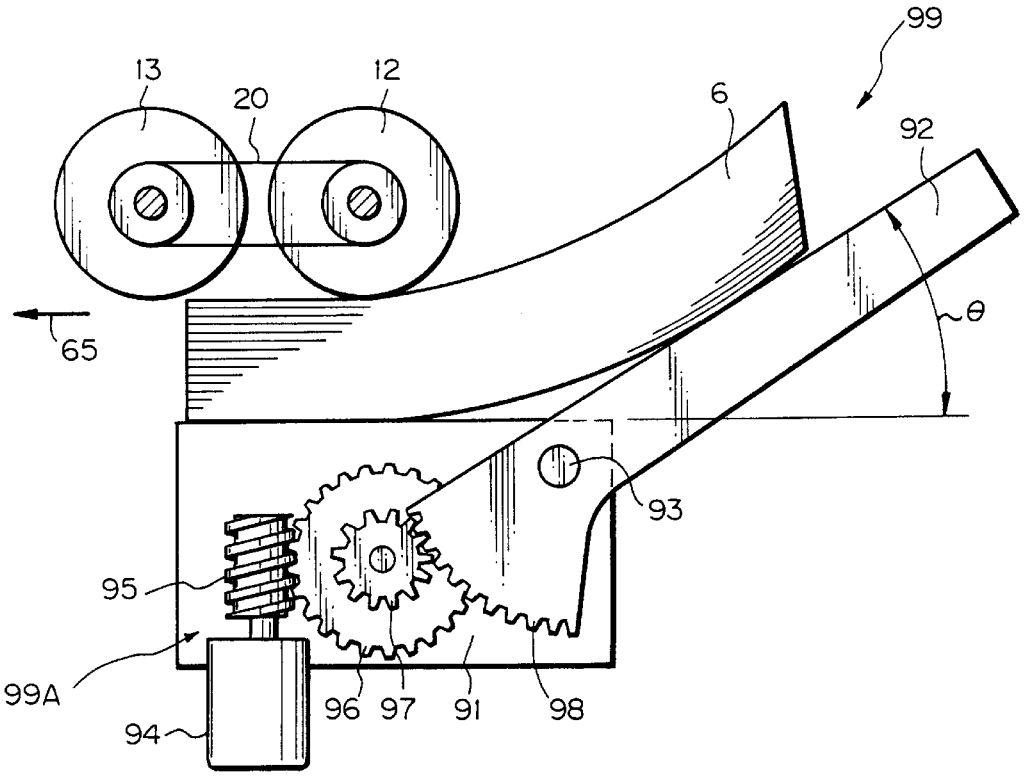
FIG. 10 is a fragmentary front view showing a tray angle adjusting mechanism representative of a third modification of the illustrative embodiment.

FIG. 10 shows a tray angle adjusting mechanism 99. As shown, the mechanism 99 has two tray parts 91 and 92 in place of the tray 4 shown in FIG. 1. The tray part 91 is elevatable while the tray part 92 is tiltable relative to the tray part 91. Tilting means 99A causes the tray part 92 to angularly move relative to the tray part 91.

The rack 10, FIG. 1, is affixed to the tray part 91. The tray part 91 is moved up and down by the tray motor 9, FIG. 1, via the pinion gear 11, FIG. 1. The tray part 92 is tiltably connected to the side wall of the tray part 91 at the upstream side in the paper feed direction 65 by a pin 93.

The tilting means 99A includes a sector gear 98 formed integrally with the downstream end of the tray part 92 in the paper feed direction 65. A tilt motor 94 is mounted on one side wall of the tray part 91 via a stationary member not shown. A worm gear 95 is mounted on the output shaft of the tilt motor 94. A worm wheel 96 is rotatably mounted on one side wall of the tray part 91 via a shaft and held in mesh with the worm gear 95. A small diameter gear 97 is mounted on the same shaft as the worm wheel 96 and held in mesh with the sector gear 98. A tray angle sensor 104 (represented by a phantom block in FIG. 3) senses the angle θ of the tray part 92.

The tilt motor 94 is implemented by a stepping motor and also represented by a phantom block in FIG. 3. The tray angle sensor 104 may be implemented by a photoencoder mounted on the motor 94, a shield plate mounted on one side wall of the tray part 92 for sensing the home position of the tray part 92, and a transmission type photosensor mounted on one side wall of the tray part 91 and selectively engageable with the shield plate. The tray part 92 is determined to be in its home position when the stacking surface of the tray part 91 and that of the tray part 92 are substantially flush with each other.

In the above construction, the tilt motor 94 is driven to tilt the tray part 92 by the angle θ which is variable in a stepwise or stepless fashion, as desired.

In the third modification, when the operator selects and inputs the kind of the papers 6, the controller 45 automatically selects an optimal transport condition matching with the kind of the papers 6,i.e., the angle θ of the tray part 92 out of a transport condition pattern table represented by Table 6 shown below.

TABLE 6

| Kind of Paper | Angle θ |
|---|---|
| Standard | 3° |
| Thick & Postcard | 10° |
| Envelope | 15° |

The controller 45 controls the tilt motor 94 such that the above angle θ matching with the kind of the papers 6 is set up. The angle θ added to the pick-up roller pressure, pad pressure and jump board angle implements more delicate control over the transport conditions in accordance with the kind of the papers 6.

To supplement the contents of Table 6, a relatively small angle θ of 3° suffices for standard papers, as indicated by the results of experiments. For thick papers and postcards, a relatively great angle θ of 10° is selected to cope with the thickness. Envelopes are stacked on the tray parts 91 and 92 with their thickest portions overlapping each other directed to the downstream side in the paper feed direction 65. Therefore, for the envelopes, an angle θ of 15° even greater than the angle θ assigned to the thick papers should preferably be selected in order to prevent the pick-up roller 12 from failing to feed them, as experimentally determined.

The contents of Table 6 are based on data derived from experiments and stored the in ROM beforehand.

Table 7 shown below roughly indicates a relation between the angle θ, feed failure, and overlap feed.

TABLE 7

| | Frequent Feed Failure ⟷ Frequent Overlap Feed |
|---|---|
| Angle θ | small ⟷ large |

As shown in Table 7, increasing the angle θ is equivalent to increasing the pick-up roller pressure and therefore results in frequent overlap feed. It follows that if overlap feed frequently occurs at, e.g., the angle θ of 3° assigned to standard papers, then the angle θ should only be reduced.

Of course, the third modification may be combined with one or both of the first and second modifications. For more delicate control, thickness and size representative of the kind of the papers 6 may be combined.

At least an optimal pick-up roller pressure and an optimal pad pressure matching with the kind of the papers 6 are selected in order to obviate feed failure and overlap feed, as shown and described. Alternatively, only one of the pick-up roller pressure and pad pressure may be adjusted on the basis of the relation shown in Table 2. A fourth and a fifth modification of the illustrative embodiment to be described hereinafter uses such an alternative control scheme.

The fourth modification controls only the pick-up roller pressure included in the three different transport conditions of the illustrative embodiment. For this purpose, the fourth modification uses the pick-up roller pressure adjusting mechanism of the illustrative embodiment. The controller 45 selects an optimal pick-up roller pressure matching with the kind of the papers 6 selected and controls the feed pressure motor 25 in such a manner as to set up the optimal pressure. Table 8 shown below lists specific pick-up roller pressures.

TABLE 8

| | Pick-Up Roller Pressure | Pad Pressure |
|---|---|---|
| Standard | 1 | 3 |
| Thin | 2 | |
| Thick | 4 | |
| Envelope | 3 | |

To supplement the contents of Table 8, when the pick-up roller pressure is varied alone, a pad pressure of about "3" is set up. This, however, would make the pad pressure excessive for thin papers, thick papers and envelopes. In the fourth modification, slightly high pick-up roller pressures corresponding to numerical values "2", "4" and "3" are respectively assigned to thin papers, thick papers and envelopes in order to avoid feed failure.

In this modification, when feed failure which is a specific transport trouble occurs, the condition changing and setting means sends a signal representative of the pattern and degree of the trouble to the controller 45. In response, the controller 45 automatically selects a corrected transport condition, i.e., a corrected pick-up roller pressure matching with the kind of the papers 6 and controls the feed pressure motor 25 in such a manner as to set up the above pressure.

This modification may include, based on the basic concept of Table 2 and a concept according to Table 3 and Table 4 of the first modification, a corrected transport condition pattern table relating to feed failure which is one of the patterns of the above trouble. Then, the degree of the pattern of the trouble can be set by selecting feed failure listed in the above table. Alternatively, the modification may include a corrected transport condition pattern table relating overlap feed which is another pattern of the trouble. In this case, the degree of the pattern of the trouble can be set by selecting overlap feed listed in the table.

The fifth modification controls only the pad pressure. For this purpose, the fifth modification uses the separation pressure adjusting mechanism of the illustrative embodiment. The controller 45 selects an optimal pad pressure matching with the kind of the papers 6 selected and controls the separation pressure motor 29 in such a manner as to set up the optimal pressure. Table 9 shown below lists specific pad pressures.

TABLE 9

| | Pad Pressure | Pick-Up Roller Pressure |
|---|---|---|
| Standard | 4 | 2 |
| Thin | 2 | |
| Thick | 1 | |
| Envelope | 1 | |

To supplement the contents of Table 9, when the pad pressure is varied alone, a pick-up roller pressure of about "2" is set up. This, however, would make the pick-up roller pressure short for thick papers and envelopes. In the fifth modification, a slightly low pad pressure corresponding to numerical value "1" is assigned to thick papers and envelopes in order to avoid feed failure.

In the fifth modification, when overlap fed which is another specific transport trouble occurs, the condition changing and setting means sends a signal representative of the pattern and degree of the trouble to the controller 45. In response, the controller 45 automatically selects a corrected transport condition, i.e., a corrected pad pressure matching with the kind of the papers 6 and controls the separation pressure motor 29 in such a manner as to set up the above pressure.

This modification may include, based on the basic concept of Table 2 and a concept according to Table 3 and Table 4 of the first modification, a corrected transport condition pattern table relating to overlap feed which is one of the patterns of the above trouble. Then, the degree of the pattern of the trouble can be set by selecting overlap feed listed in the above table. Alternatively, the modification may include a corrected transport condition pattern table relating to feed failure which is another pattern of the trouble. In this case, the degree of the pattern of the trouble can be set by selecting feed failure listed in the table.

The present invention is not limited to the illustrative embodiment or the first to fifth modifications thereof. For example, in a printer including a suitable combination of a feed pressure adjusting mechanism, a separation pressure adjusting mechanism, a jump board angle adjusting mechanism, and a tray angle adjusting mechanism, an arrangement may be made such that control means automatically selects, in response to the output of kind-of-paper setting means or condition changing and setting means, optimal transport conditions relating to the above mechanisms and controls variable drive sources respectively included in the mechanisms.

In summary, it will be seen that the present invention provides a printer having various unprecedented advantages, as enumerated below.

(1) Only if the operator selects and inputs the kind of papers to be used, control means automatically selects optimal transport conditions and sets them without resorting to operator's manual switching operation. This successfully obviates overlap feed, feed failure jam and other troubles relating to paper transport at at least a paper feed section.

(2) Even an untrained person can immediately input the kind of papers without any doubt while watching information appearing on an LCD provided on an operation panel.

(3) The operator should only select and input the kind and frequency of a trouble while watching the LCD of the operation panel. The control means automatically varies the transport conditions set beforehand and sets up optimal corrected transport conditions for obviating the trouble. This realizes an extremely simple measure for dealing with transport troubles.

(4) At least standard papers and thick papers can be selected and input as the kinds of papers. Such papers can therefore be used more effectively than papers conventionally used with printers.

(5) Optimal transport conditions selected can be stored in the control means and can therefore be called every time papers of the same kind are used. This makes it needless for the operator to set transport conditions each time.

Various modifications will become possible for those skilled in the art after receiving the teachings of the present disclosure without departing from the scope thereof.

What is claimed is:

1. A printer for printing an image on a paper paid out by feeding means and separated from other papers by separating means, said printer comprising:

kind-of-paper setting means for allowing an operator to select and input a kind of paper to be used;

control means for automatically selecting, from among transport conditions stored beforehand in correspondence to the kind of paper, the transport conditions matching the kind of paper which has been input by the operator in response to a signal received from said kind-of-paper setting means; and condition changing and setting means for allowing the operator to select, when a trouble relating to paper transport occurs, information corresponding to a pattern and a degree of the trouble and inputting the information, said control means automatically selecting and setting corrected transport conditions stored beforehand in correspondence to the transport conditions matching the kind of paper.

2. The printer as claimed in claim 1, further comprising display means for displaying, when the operator inputs the kind of paper on said kind-of-paper setting means, specific characteristics of said kind of paper.

3. The printer as claimed in claim 2, wherein said display means comprises an LCD (Liquid Crystal Display) mounted on an operation panel portion.

4. The printer as claimed in claim 3, further comprising a feed pressure adjusting mechanism including a variable feed pressure drive source, said control means selecting a paper feed pressure out of the transport conditions matching the kind of paper, and controlling said variable feed pressure drive source to thereby set up said paper feed pressure.

5. The printer as claimed in claim 3, further comprising a separation pressure adjusting mechanism including a variable separation pressure drive source, said control means selecting a paper separation pressure out of the transport conditions matching with the kind of paper, and controlling said variable separation pressure drive source to thereby set up said paper separation pressure.

6. The printer as claimed in claim 3, further comprising a feed pressure adjusting mechanism and a separation pressure adjusting mechanism respectively including a variable feed pressure drive source and a variable separation pressure drive source, said control means selecting at least a paper feed pressure and a paper separation pressure out of the transport conditions matching the kind of paper, and controlling said variable feed pressure drive source and said variable separation pressure drive source to thereby set up said paper feed pressure and said paper separation pressure, respectively.

7. The printer as claimed in claim 3, wherein at least either one of a standard paper and a thick paper is selectable on said kind-of-paper setting means as the kind of papers.

8. The printer as claimed in claim 3, wherein a special paper particular to a user is selectable on said kind-of-paper setting means as the kind of papers.

9. The printer as claimed in claim 2, further comprising a feed pressure adjusting mechanism including a variable feed pressure drive source, said control means selecting a paper feed pressure out of the transport conditions matching the kind of paper, and controlling said variable feed pressure drive source to thereby set up said paper feed pressure.

10. The printer as claimed in claim 2, further comprising a separation pressure adjusting mechanism including a variable separation pressure drive source, said control means selecting a paper separation pressure out of the transport conditions matching the kind of paper, and controlling said variable separation pressure drive source to thereby set up said paper separation pressure.

11. The printer as claimed in claim 2, further comprising a feed pressure adjusting mechanism and a separation pressure adjusting mechanism respectively including a variable feed pressure drive source and a variable separation pressure drive source, said control means selecting at least a paper feed pressure and a paper separation pressure out of the transport conditions matching the kind of paper, and controlling said variable feed pressure drive source and said variable separation pressure drive source to thereby set up said paper feed pressure and said paper separation pressure, respectively.

12. The printer as claimed in claim 2, wherein at least either one of a standard paper and a thick paper is selectable on said kind-of-paper setting means as the kind of papers.

13. The printer as claimed in claim 2, wherein a special paper particular to a user is selectable on said kind-of-paper setting means as the kind of papers.

14. The printer as claimed in claim 1, further comprising feed pressure adjusting mechanism including a variable feed pressure drive source, said control means selecting a paper feed pressure out of the transport conditions matching the kind of paper, and controlling said variable feed pressure drive source to thereby set up said paper feed pressure.

15. The printer as claimed in claim 14, wherein the pattern of the trouble is a failure of paper feed, and wherein a degree of said pattern is capable of being set by selecting said failure of paper feed.

16. The printer as claimed in claim 14, wherein the pattern of the trouble is a failure of a simultaneous feed of two or more papers, and wherein a degree of said pattern is capable of being set by selecting said simultaneous feed.

17. The printer as claimed in claim 1, wherein the pattern of the trouble is a failure of paper feed, and wherein a degree of said pattern is capable of being set by selecting said failure of paper feed.

18. The printer as claimed in claim 1, wherein the pattern of the trouble is a simultaneous feed of two or more papers, and wherein a degree of said pattern is capable of being set by selecting said simultaneous feed.

19. The printer as claimed in claim 1, further comprising a separation pressure adjusting mechanism including a variable separation pressure drive source, said control means selecting a paper separation pressure out of the transport conditions matching the kind of paper, and controlling said variable separation pressure drive source to thereby set up said paper selection pressure.

20. The printer as claimed in claim 19, wherein the pattern of the trouble is a simultaneous feed of two or more papers, and wherein a degree of said pattern is capable of being set by selecting said simultaneous feed.

21. The printer as claimed in claim 19, wherein the pattern of the trouble is a failure of paper feed, and wherein a degree of said pattern is capable of being set by selecting said failure of paper feed.

22. The printer as claimed in claim 1, further comprising a feed pressure adjusting mechanism and a separation pressure adjusting mechanism respectively including a variable feed pressure drive source and a variable separation pressure drive source, said control means selecting at least a paper feed pressure and a paper separation pressure out of the transport conditions matching the kind of paper, and controlling said variable feed pressure drive source and said variable separation pressure drive source to thereby set up said paper feed pressure and said paper separation pressure, respectively.

23. The printer as claimed in claim 22, wherein the pattern of the trouble is at least either one of a failure of paper feed and a simultaneous feed of two or more papers, and wherein a degree of said pattern is capable of being set by selecting either said failure or said simultaneous feed.

24. The printer as claimed in claim 1, wherein the pattern of the trouble is at least either one of a failure of paper feed and a simultaneous feed of two or more papers, and wherein a degree of said pattern is capable of being set by selecting either said failure or said simultaneous feed.

25. The printer as claimed in claim 1, wherein at least either one of a standard paper and a thick paper is selectable on said kind-of-paper setting means as the kind of papers.

26. The printer as claimed in claim 1, wherein a special paper particular to a user is selectable on said kind-of-paper setting means as the kind of papers.

27. A printer for printing an image on a paper paid out by feeding means and separated from other papers by separating means, said printer comprising:

kind-of-paper setting means for allowing an operator to select and input a kind of paper to be used;

control means for automatically selecting, from among transport conditions stored beforehand in correspondence to the kind of paper, at least one transport condition matching the kind of paper which have been input by the operator in response to a signal received from said kind-of-paper setting means; and condition changing and setting means for allowing the operator to select, when a trouble relating to paper transport occurs, information corresponding to a pattern and a degree of the trouble and inputting the information, said control means automatically selecting and setting corrected transport conditions stored beforehand in correspondence to the transport conditions matching the kind of paper, wherein the pattern of the trouble is at least any one of a failure of paper feed and a simultaneous feed of two or more papers, and wherein a degree of said pattern is capable of being set by selecting either said failure or said simultaneous feed.

28. The printer as claimed in claim 27, further comprising display means for displaying, when the operator inputs the kind of paper on said kind-of-paper setting means, specific contents of said kind of paper.

29. The printer as claimed in claim 28, wherein said display means comprises an LCD (Liquid Crystal Display) mounted on an operation panel portion.

30. The printer as claimed in claim 29, further comprising a feed pressure adjusting mechanism including a variable feed pressure drive source, said control means selecting a paper feed pressure out of the transport conditions matching the kind of paper, and controlling said variable feed pressure drive source to thereby set up said paper feed pressure.

31. The printer as claimed in claim 29, further comprising a separation pressure adjusting mechanism including a variable separation pressure drive source, said control means selecting a paper separation pressure out of the transport conditions matching with the kind of paper, and controlling said variable separation pressure drive source to thereby set up said paper separation pressure.

32. The printer as claimed in claim 29, further comprising a feed pressure adjusting mechanism and a separation pressure adjusting mechanism respectively including a variable feed pressure drive source and a variable separation pressure drive source, said control means selecting at least a paper feed pressure and a paper separation pressure out of the transport conditions matching the kind of paper, and controlling said variable feed pressure drive source and said variable separation pressure drive source to thereby set up said paper feed pressure and said paper separation pressure, respectively.

33. The printer as claimed in claim 29, wherein at least either one of a standard paper and a thick paper is selectable on said kind-of-paper setting, means as the kind of papers.

34. The printer as claimed in claim 29, wherein a special paper particular to a user is selectable on said kind-of-paper setting means as the kind of papers.

35. The printer as claimed in claim 28, further comprising a feed pressure adjusting mechanism including a variable feed pressure drive source, said control means selecting a paper feed pressure out of the transport conditions matching the kind of paper, and controlling said variable feed pressure drive source to thereby set up said paper feed pressure.

36. The printer as claimed in claim 28, further comprising a separation pressure adjusting mechanism including a variable separation pressure drive source, said control means selecting a paper separation pressure out of the transport conditions matching the kind of papers, and controlling said variable separation pressure drive source to thereby set up said paper separation pressure.

37. The printer as claimed in claim 28, further comprising a feed pressure adjusting mechanism and a separation pressure adjusting mechanism respectively including a variable feed pressure drive source and a variable separation pressure drive source, said control means selecting at least a paper feed pressure and a paper separation pressure out of the transport conditions matching the kind of paper, and controlling said variable feed pressure drive source and said variable separation pressure drive source to thereby set up said paper feed pressure and said paper separation pressure, respectively.

38. The printer as claimed in claim 28, wherein at least either one of a standard paper and a thick paper is selectable on said kind-of-paper setting means as the kind of papers.

39. The printer as claimed in claim 28, wherein a special paper particular to a user is selectable on said kind-of-paper setting means as the kind of papers.

40. The printer as claimed in claim 27, further comprising a feed pressure adjusting mechanism including a variable feed pressure drive source, said control means selecting a paper feed pressure out of the transport conditions matching the kind of papers, and controlling said variable feed pressure drive source to thereby set up said paper feed pressure.

41. The printer as claimed in claim 27, further comprising a separation pressure adjusting mechanism including a variable separation pressure drive source, said control means selecting a paper separation pressure out of the transport conditions matching the kind of paper, and controlling said variable separation pressure drive source to thereby set up said paper selection pressure.

42. The printer as claimed in claim 27, further comprising a feed pressure adjusting mechanism and a separation pressure adjusting mechanism respectively including a variable feed pressure drive source and a variable separation pressure drive source, said control means selecting at least a paper feed pressure and a paper separation pressure out of the transport conditions matching the kind of paper, and controlling said variable feed pressure drive source and said variable separation pressure drive source to thereby set up said paper feed pressure and said paper separation pressure, respectively.

43. The printer as claimed in claim 27, wherein at least either one of a standard paper and a thick paper is selectable on said kind-of-paper setting means as the kind of papers.

44. The printer as claimed in claim 27, wherein a special paper particular to a user is selectable on said kind-of-paper setting means as the kind of papers.

45. A printer for printing an image on a paper paid out by feeding means and separated from other papers by separating means, said printer comprising:

kind-of-paper setting means for allowing an operator to select and input a kind of paper to be used;

control means for automatically selecting, from among transport conditions stored beforehand in correspondence to the kind of paper, at least one transport condition matching the kind of paper which have been input by the operator in response to a signal received from said kind-of-paper setting means;

condition changing and setting means for allowing the operator to select, when a trouble relating to paper transport occurs, information corresponding to a pattern and a degree of the trouble and inputting the information, said control means automatically selecting and setting corrected transport conditions stored beforehand in correspondence to the transport conditions matching the kind of paper; and display means for displaying, when the operator inputs the kind of paper on said kind-of-paper setting means, specific contents of said kind of paper, wherein said display means comprises an LCD (Liquid Crystal Display) mounted on an operation panel portion.

46. The printer as claimed in claim 45, further comprising a feed pressure adjusting mechanism including a variable feed pressure drive source, said control means selecting a paper feed pressure out of the transport conditions matching the kind of paper, and controlling said variable feed pressure drive source to thereby set up said paper feed pressure.

47. The printer as claimed in claim 45, further comprising a separation pressure adjusting mechanism including a variable separation pressure drive source, said control means selecting a paper separation pressure out of the transport conditions matching with the kind of paper, and controlling said variable separation pressure drive source to thereby set up said paper separation pressure.

48. The printer as claimed in claim 45, further comprising a feed pressure adjusting mechanism and a separation pressure adjusting mechanism respectively including a variable feed pressure drive source and a variable separation pressure drive source, said control means selecting at least a paper feed pressure and a paper separation pressure out of the transport conditions matching the kind of paper, and controlling said variable feed pressure drive source and said variable separation pressure drive source to thereby set up said paper feed pressure and said paper separation pressure, respectively.

49. The printer as claimed in claim 45, wherein the pattern of the trouble is a failure of paper feed, and wherein a degree of said pattern is capable of being set by selecting said failure of paper feed.

50. The printer as claimed in claim 45, wherein the pattern of the trouble is a failure of a simultaneous feed of two or more papers, and wherein a degree of said pattern is capable of being set by selecting said simultaneous feed.

51. The printer as claimed in claim 45, wherein at least either one of a standard paper and a thick paper is selectable on said kind-of-paper setting means as the kind of papers.

52. The printer as claimed in claim 45, wherein a special paper particular to a user is selectable on said kind-of-paper setting means as the kind of papers.

* * * * *

UNITED STATES PATENT AND TRADEMARK OFFICE

CERTIFICATE OF CORRECTION

PATENT NO. : 6,213,015 B1
DATED : April 10, 2001
INVENTOR(S) : Mitsuo Sato et al.

It is certified that error appears in the above-identified patent and that said Letters Patent is hereby corrected as shown below:

Column 1,
Line 1, change "mediumquality" to -- medium quality --.

Column 3,
Line 9, change "damper" to -- clamper --.

Column 5,
Line 16, change "positionsensing" to -- position sensing --;
Line 17, change "board52" -- to board 52 --; and
Line 20, after "type", delete "6".

Column 7,
Lines 51-52, change "control led" to -- control-led --.

Column 8,
Line 1, change "control led" to -- controlled --;
Line 2, change "control ler" -- controller --;
Line 4, change "memory" to -- Memory --;
Line 11, change "al lows" to -- allows --; and
Line 13, change "control ler" to -- controller --.

Column 9,
Line 37, change "control ler" to -- controller --.

Column 10,
Line 17, change "Lying" -- lying --.

Column 11,
Line 20, change "control ler" to -- controller --;
Line 39, change "control ler" to -- controller --;
Line 51, change "I" change to -- 1 --.

Column 12,
Line 32, change "control ler" change to -- controller --.

Column 13,
Line 44, change "over lap" change to -- overlap --.

UNITED STATES PATENT AND TRADEMARK OFFICE

CERTIFICATE OF CORRECTION

PATENT NO. : 6,213,015 B1
DATED : April 10, 2001
INVENTOR(S) : Mitsuo Sato et al.

It is certified that error appears in the above-identified patent and that said Letters Patent is hereby corrected as shown below:

Column 14,
Line 4, change "amedium" change to -- a medium --.

Signed and Sealed this

Twenty-second Day of January, 2002

*Attest:*

*Attesting Officer*

JAMES E. ROGAN
*Director of the United States Patent and Trademark Office*